US005984045A

United States Patent [19]

Maeda et al.

[11] Patent Number: 5,984,045

[45] Date of Patent: Nov. 16, 1999

[54] ENGINE EXHAUST NOISE SUPPRESSOR

[75] Inventors: Kazushige Maeda, Yokohama; Akira Sasaki, Yokosuka, both of Japan

[73] Assignee: Nissan Motor Co., Ltd., Kanagawa, Japan

[21] Appl. No.: 09/023,426

[22] Filed: Feb. 13, 1998

[30] Foreign Application Priority Data

Feb. 14, 1997 [JP] Japan ..... 9-030479
Feb. 14, 1997 [JP] Japan ..... 9-030480

[51] Int. Cl.[6] ..... F01N 1/00

[52] U.S. Cl. ..... 181/254; 181/265; 181/272

[58] Field of Search ..... 181/237, 254, 181/264, 265, 268, 269, 272, 273, 276, 250

[56] References Cited

U.S. PATENT DOCUMENTS 4,971,166 11/1990 Hase ..... 181/254
5,614,699 3/1997 Yashiro et al. ..... 181/254
5,801,343 9/1998 Suzuki et al. ..... 181/254

FOREIGN PATENT DOCUMENTS

WO 95/13460 5/1995 WIPO .

*Primary Examiner*—Khanh Dang
*Attorney, Agent, or Firm*—McDermott, Will & Emery

[57] ABSTRACT

The inner area of a muffler of an engine is partitioned into an expansion chamber, a first volume chamber and a second volume chamber. An inlet tube and the first volume chamber are connected by a first passage. The first volume chamber and a second volume chamber are connected by a second passage, and the second volume chamber and expansion chamber are connected by a third passage. The flow of exhaust gas reaching the expansion chamber via the first passage, second passage and third passage is blocked by a valve which opens according to a pressure rise of the exhaust gas. One of the two acoustic paths formed when the valve is open functions as a resonator having two degrees of freedom relative to the other path so that a high muffling effect is obtained.

20 Claims, 16 Drawing Sheets

ENGINE EXHAUST NOISE SUPPRESSOR

FIELD OF THE INVENTION

This invention relates to an exhaust noise suppressor using a muffler for reducing the noise from the exhaust gas of an engine.

BACKGROUND OF THE INVENTION

It is desirable that the exhaust noise of a vehicle is reduced from low rotation speed to high rotation speed of an engine without increasing exhaust pressure loss. WO95/13460 published by the World Intellectual Properties Organization (WIPO) in 1995 for example discloses a muffler wherein a valve responding to exhaust pressure is provided, and the flowpath of exhaust inside the muffler is changed according to the exhaust pressure.

In this device, first and second expansion chambers and a volume chamber are formed inside the muffler. When exhaust pressure is low, exhaust gas introduced into the muffler by an inlet tube is discharged from a tail tube through the two expansion chambers. When exhaust pressure exceeds a predetermined value, a part of the exhaust gas flows from the first expansion chamber into the second expansion chamber via the volume chamber. The above-mentioned valve is installed in a pipe connecting the volume chamber and the second expansion chamber.

In this case, considering the exhaust gas flowpath which does not pass through the volume chamber as a first path, and the exhaust flowpath which passes through the volume chamber as a second path, the second flowpath functions as a resonator having one degree of freedom with respect to the first flowpath.

The sound wave which passes through the first path is shifted by 180 degrees relative to the sound wave which passes through the second path with the resonance frequency as a boundary, so the pressure waves in the two paths effectively have reverse phase. Therefore the sound waves at the confluence of the two paths in the second expansion chamber mutually interfere which brings about the noise reduction effect.

However, as the resonator formed by the second path relative to the first path in this device effectively has one degree of freedom, in the frequency regions extending beyond anti-resonance frequency on both sides of the resonance frequency, the sound pressure level of the second path drops, and a large difference therefore arises from the level of the first path in these regions.

Therefore, although the sound waves traveling through the first and second paths have reversed phase in the confluence part, a noise reduction. effect due to mutual interference of sound waves can be expected only in a narrow region around the resonance frequency.

Further, if a plurality of expansion chambers are provided in the muffler, the volume of each chamber is small, and muffling performance at low frequencies is not very high.

SUMMARY OF THE INVENTION

It is therefore an object of this invention to enhance the noise reduction effect of an exhaust noise suppressor for a vehicle by mutual interference of sound waves.

It is a further object of this invention to enhance the low frequency noise reduction performance of an exhaust noise suppressor for a vehicle.

In order to achieve the above objects, this invention provides an exhaust noise suppressor for use with an engine.

The suppressor comprises a muffler whereof the inner area is partitioned into a expansion chamber, a first volume chamber and second volume chamber, an inlet tube for leading engine exhaust gas into the expansion chamber, a tail tube for discharging exhaust gas of the expansion chamber outside the muffler, a first passage connecting the expansion chamber and the first volume chamber, a second passage connecting the first volume chamber and second volume chamber, a third passage connecting the second volume chamber and the expansion chamber, a valve for blocking a flow of exhaust gas reaching the expansion chamber from the inlet tube via the first passage, the second passage and the third passage. This valve is arranged to open according to a pressure increase of the flow of the exhaust gas.

It is preferable that the first volume chamber and second volume chamber form a resonator connected in parallel with the expansion chamber.

It is also preferable that the first volume chamber and the second volume chamber form a resonator connected in series with the expansion chamber.

It is also preferable that the inlet tube is connected to the expansion chamber via numerous small holes formed in the inlet tube in the expansion chamber, a total opening area of the small holes is set so that a pressure of the first volume chamber is higher than a pressure of the second volume chamber, and the first passage is formed by a downstream part of the inlet tube situated further downstream than the small holes.

It is also preferable that the first passage is formed by a pipe fitted such that a gap is left with the inlet tube in the expansion chamber and a crosssectional surface area of the gap is set so that the pressure of the first volume chamber is higher than the pressure of the second volume chamber.

It is also preferable that the second volume chamber is arranged between the expansion chamber and the first volume chamber, and the first passage passes through the second volume chamber.

It is also preferable that the expansion chamber is arranged between the second volume chamber and the first volume chamber, and the second passage is formed by a pipe passing through the expansion chamber.

It is also preferable that the first passage comprises a branch pipe branching off the inlet tube.

It is also preferable that the first volume chamber and the second volume chamber are partitioned by a baffle plate, the second passage is formed by a pipe passing through the baffle plate, and the valve comprises a valve seat provided in an opening of the pipe which extends from the baffle plate, a valve body which can seat in the valve seat for closing the opening, and a spring for pushing the valve body towards a seated position.

In this case it is further preferable that the valve further comprises a bracket for supporting the valve body free to pivot. The bracket is preferably formed for a one-piece construction with the valve seat or with the baffle plate.

It is also preferable that the first volume chamber and the second volume chamber are partitioned by a baffle plate, the second passage is formed by an opening formed in the baffle plate, and the valve comprises a valve seat provided in the opening, a valve body which can seat in the valve seat for closing the opening, and a spring for pushing the valve body towards a seated position.

It is also preferable that first passage comprises a downstream part of the inlet tube having an opening into the first volume chamber.

In this case it is further preferable that It is also preferable that the valve is provided in the opening of the inlet tube.

It is also preferable that the first passage comprises a branch which branches off the inlet tube. This branch pipe is arranged to have an opening, into the first volume chamber.

In this case it is further preferable that the valve is provided in this opening.

It is also preferable that the inlet tube is connected to the expansion chamber via a first group of numerous small holes formed in the inlet tube in the expansion chamber, the inlet tube is connected to the first volume chamber via a second group of numerous small holes formed in the inlet tube in the first volume chamber, and the first passage comprises a portion of the inlet tube from the first group of small holes to the second group of small holes.

It is also preferable that the third passage comprises a pipe, and the valve comprises a valve seat provided in an opening of the pipe, a valve body which can seat in the valve seat for closing the opening, and a spring for pushing the valve body towards a seated position.

It Is also preferable that the second passage and the third passage comprise two pipes arranged coaxially with the tail tube.

It is also preferable that the second volume chamber and the expansion chamber are partitioned by a baffle plate, the third passage comprises a pipe passing through the baffle plate, and the valve comprises a valve seat provided in an opening of the pipe which extends from the baffle plate, a valve body which can seat in the valve seat for closing the opening, and a spring for pushing the valve body towards a seated position.

It is also preferable that the first volume chamber and the expansion chamber are partitioned by a baffle plate, the third passage comprises a pipe passing through the first volume chamber, and the valve comprises a valve seat provided in an opening of the pipe which is formed in the baffle plate, a valve body which can seat in the valve seat for closing the opening, and a spring for pushing the valve body towards a seated position.

The details as well as other features and advantages of this invention are set forth in the remainder of the specification and are shown in the accompanying drawings.

DESCRIPTION OF THE PREFERRED EMBODIMENTS

A first embodiment of this invention will now be described referring to FIGS. 1–3 of the drawings.

Figure 1:
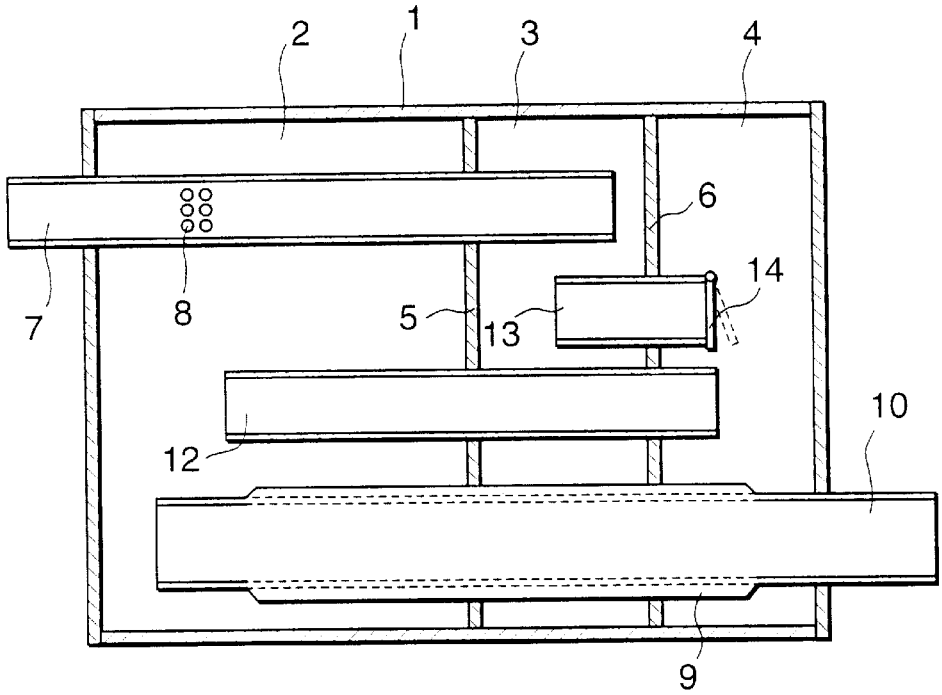
FIG. 1 is a longitudinal sectional view of an exhaust noise suppressor according to a first embodiment of this invention.
Figure 2:
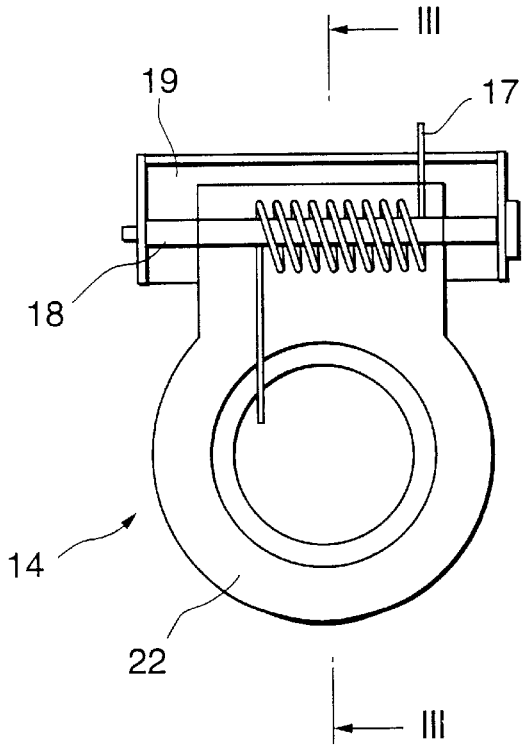
FIG. 2 is a front view of a valve according to the first embodiment of this invention.

The inside of a cylindrical muffler 1 shown in FIG. 1 is partitioned into an expansion chamber 2, a first volume chamber 3 and a second volume chamber 4 by baffle plates 5 and 6. The first volume chamber 3 is formed between the expansion chamber 2 and the second volume chamber 4.

Exhaust gas from an engine, not shown, is led into the muffler 1 by an inlet tube 7. The inlet tube 7 passes through the expansion chamber 2, and opens into the first volume chamber 3. The inlet tube 7 is connected to the expansion chamber 2 via numerous small holes 8 formed along its circumference.

The aperture ratio of the holes 8, i.e. the ratio of the total opening surface area of all the holes 8 relative to the opening area of the inlet tube 7 at its end, is set so that the pressure of the first volume chamber 3 always exceeds the pressure of the volume chamber 4.

One end of a tail tube 10 opens into the expansion chamber 2. The tail tube 10 passes through the first volume chamber 3 and the second volume chamber 4, and is led outside the muffler 1, its opposite end being open to the atmosphere.

A sound absorbing member 9 is provided midway along the tail tube 10. The sound absorbing member 9 comprises a sound absorbing material which covers numerous small holes formed along the tail tube 10, and the outer circumference of this sound absorbing material is covered by an outer tube. The sound absorbing material has the effect of damping exhaust noise of the exhaust gas passing through the tail tube 10, and the outer tube has the effect of preventing the exhaust gas in the tail tube 10 from flowing out into the interior of the muffler 1 through the sound absorbing material.

The first volume chamber 3 and expansion chamber 2 are mutually connected via the small holes 8 and a downstream part of the inlet tube 7. As a result, a pulsation pressure of the expansion chamber 2 is led to the first volume chamber 3, and the first volume chamber 3 damps exhaust noise of a predetermined frequency.

The second volume chamber 4 is connected to the expansion chamber 2 via a connecting tube 12 passing through the baffle plates 5 and 6. The pulsation pressure of the expansion chamber 2 is led to the second volume chamber 4 via the connecting tube 12, and the second volume chamber 4 also damps exhaust noise of a predetermined frequency. The first volume chamber 3 and the second volume chamber 4 are connected via a connecting tube 13 passing through the baffle plate 6. A valve 14 which opens according to the exhaust pressure of the first volume chamber 3 is provided in the connecting tube 13.

The valve 14 is provided at one end of the connecting tube 13 in the second volume chamber 4. The valve 14 is shown in FIGS. 2 and 3 in detail.

The valve 14 comprises a valve seat 20 of the bell type which is fixed to the baffle plate 6 and extends from the baffle plate 6 into the second volume chamber 4, and a valve body 22 which is seated in the valve seat 20 and closes the connecting tube 13. The connecting tube 13 passes through the baffle plate 6, and tightly fits the internal circumference of the valve seat 20.

If the valve seat 20 is formed in a one-piece construction with the connecting tube 13, the number of parts can be reduced, and the muffler 1 can be made lightweight.

The valve body 22 is a disk-shaped member supported free to pivot on an axis 18. The axis 18 is supported by a fixed bracket 19 by, e.g. welding to the baffle plate 6.

The valve body 22 is pushed toward the valve seat 20 by a return spring 17 wound on the axis 18. One end of the return spring 17 comes in contact with the valve body 22, and the other end comes in contact with the bracket 19.

Figure 3:
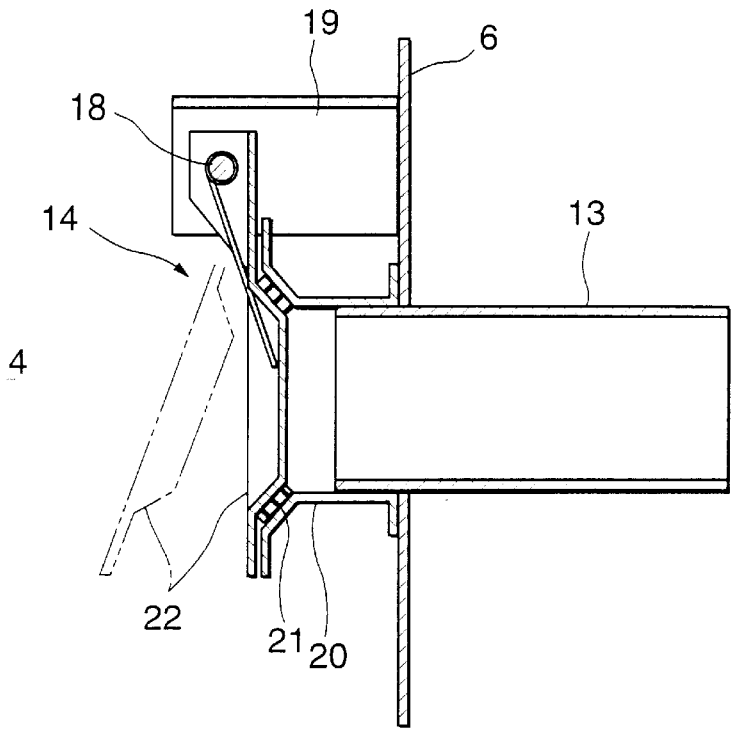
FIG. 3 is a sectional view of the valve taken along a line III—III of FIG. 2.

The valve 14 is normally maintained in the closed state by the return spring 17, and when a difference in pressure between the first volume chamber 3 and the second volume chamber 4 exceeds a predetermined value, the valve body 22 pivots about the axis 18 against the force of the return spring 17 so that the second volume chamber 4 connects with the connecting tube 13, as shown in FIG. 3.

An annular pad 21 is provided at a position in which the valve body 22 comes in contact with the valve seat 20. The pad 21 which is formed of an elastic material adsorbs the shock and dampens the noise when the valve body 22 is seated in the valve seat 20.

In this muffler, in the low engine rotation speed region when the valve 14 is closed, all the exhaust gas which flows into the muffler 1 enters the expansion chamber 2 via the small holes 8, and is discharged via the tail tube 10. In this case, the expansion chamber 2 acts as an extension element which damps the noise of the flow of exhaust gas.

In this device, as both the inlet tube 7 and the tail tube 10 open into the same expansion chamber 2, maximum chamber volume can be obtained within a limited muffler volume. For this reason, the path leading from the inlet tube 7 to the expansion chamber 2 through the small holes 8 has a large expansion ratio, and exhaust noise is largely reduced by this expansion effect.

In this state, the first volume chamber 3 connected by the downstream part of the inlet tube 7 to the expansion chamber 2 functions as a first resonator which dampens exhaust noise at a predetermined frequency. As the expansion chamber 2 and the first volume chamber 3 are connected through the downstream part of the inlet tube 7, the length and diameter of the connecting path can be set sufficiently large. Also, as the pressure pulsation of the inlet tube 7 is directly transmitted to the first volume chamber 3, good low frequency muffling performance is obtained.

The second volume chamber 4 connecting to the expansion chamber 2 via the connecting tube 12 functions as a second resonator damping exhaust noise at a predetermined frequency. The length and diameter of the flowpath of the connecting tube 12 can be set sufficiently large, and so good low frequency muffling performance is obtained.

When there is a large degree of freedom for setting the length and diameter of the downstream part of the tail tube 7 and the connecting tube 12 respectively forming the resonators, muffling performance for low frequency noise components in synchronism with low engine rotation speeds can be enhanced. Exhaust "stuttering" noise in a passenger compartment of a vehicle is thereby reduced.

When the valve 14 opens due to exhaust pressure at high engine rotation speeds, part of the exhaust gas led from the inlet tube 7 into the muffler 1 enters the first volume chamber 3 via the downstream part of the inlet tube 7, enters the second volume chamber 4 via the connecting tube 13, and enters the expansion chamber 2 via the connecting tube 12. The exhaust gas therefore splits into two paths in the muffler 1, energy losses are reduced and high engine output is obtained.

A first path comprises the inlet tube 7, small holes 8, expansion chamber 2 and tail tube 10, and a second path comprises the inlet tube 7, first volume chamber 3, connecting tube 13, second volume chamber 4, connecting tube 12, expansion chamber 2 and tail tube 10. These two paths respectively have an acoustic opening into the common expansion chamber 2.

Therefore, the two resonance systems function together, and the second path acts as a resonator having effectively two degrees of freedom relative to the first path. Also, there are two resonance frequencies in the second path, and anti-resonance frequencies above and below each of these resonance frequencies. Therefore, there is a total of four anti-resonance frequencies.

Between two anti-resonance frequencies, the acoustic level is the same as that of the first path. In this noise suppressor, the acoustic level of exhaust gas which has passed through the second exhaust path has peaks at each of the four anti-resonance frequencies.

In the frequency region between these peaks, the acoustic level is high, and the acoustic level falls as the frequency increases beyond the highest frequency peak. Similarly, the acoustic level falls as the frequency decreases below the lowest frequency peak.

Insofar as concerns the phase of the sound wave, as in the case of a resonator having one degree of freedom such as in the prior art, the acoustic waveform of the second path is 180 degrees phase shifted relative to the waveform of the first path at the first resonance frequency as a boundary. Beyond the next resonance frequency, it is shifted by 180 degrees again so that it has identical phase to the waveform of the first path. Between the anti-resonance peaks the phase is opposite, and the acoustic pressure levels are effectively identical.

Therefore, between the minimum anti-resonance peak and maximum resonance peak, the pressure waves interfere in the expansion chamber 2 which is the confluence area for the first and second paths, and cancel each other out. A good muffling effect is thereby obtained over a wide frequency range.

In this noise suppressor, the valve seat 20 extends from the baffle plate 6, and as the connecting tube 13 fits inside the valve seat 20, tubes 13 of different diameter may be fitted to the same valve seat 20 with a simple arrangement.

Hence an identical valve seat 20 may be used for different engines, and productivity can be increased.

Figure 4:
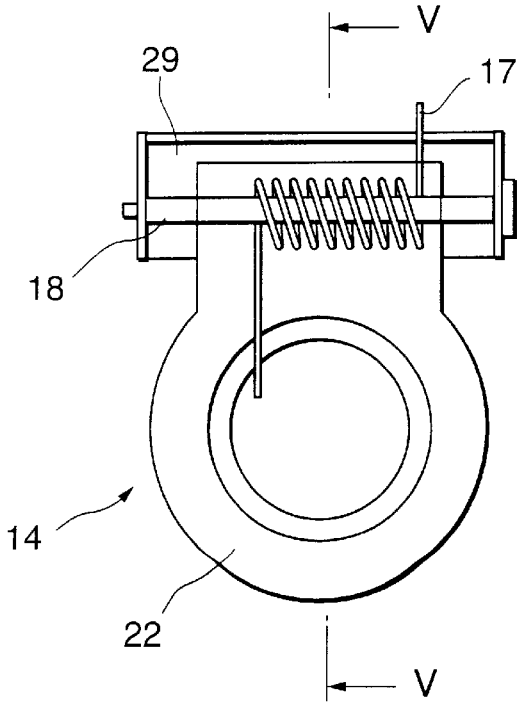
FIG. 4 is a front view of a valve according to a second embodiment of this invention.
Figure 5:
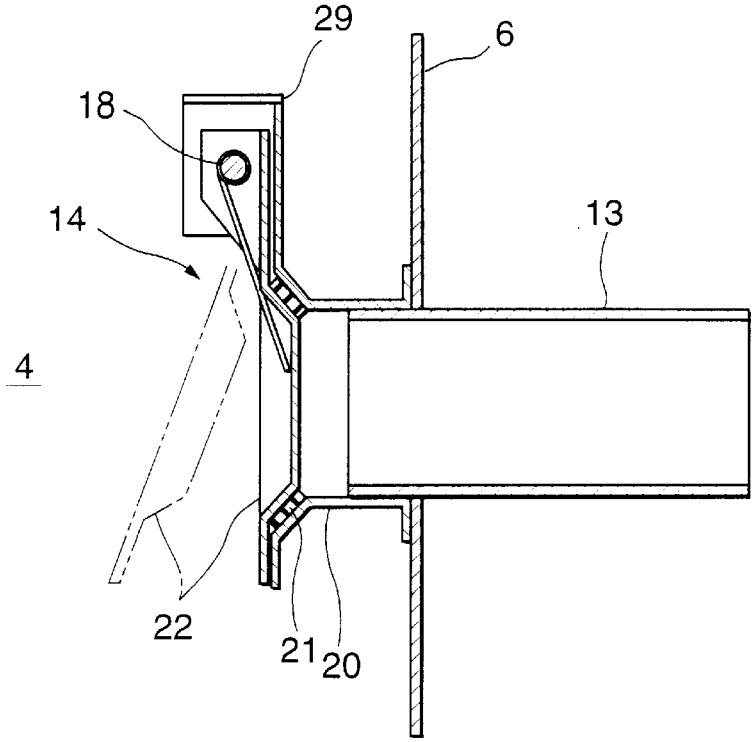
FIG. 5 is a longitudinal sectional view of the valve taken along a line V—V of FIG. 4.

FIGS. 4 and 5 show a second embodiment of this invention.

This embodiment relates to the construction of the valve 14, the axis 18 being supported by the valve seat 20 and a bracket 29 in a one-piece construction.

Due to this, the valve 14 may be formed as a separate unit independent of the baffle plate 6. Such a modular construction has a desirable effect on quality control of the valve 14.

Figure 6:
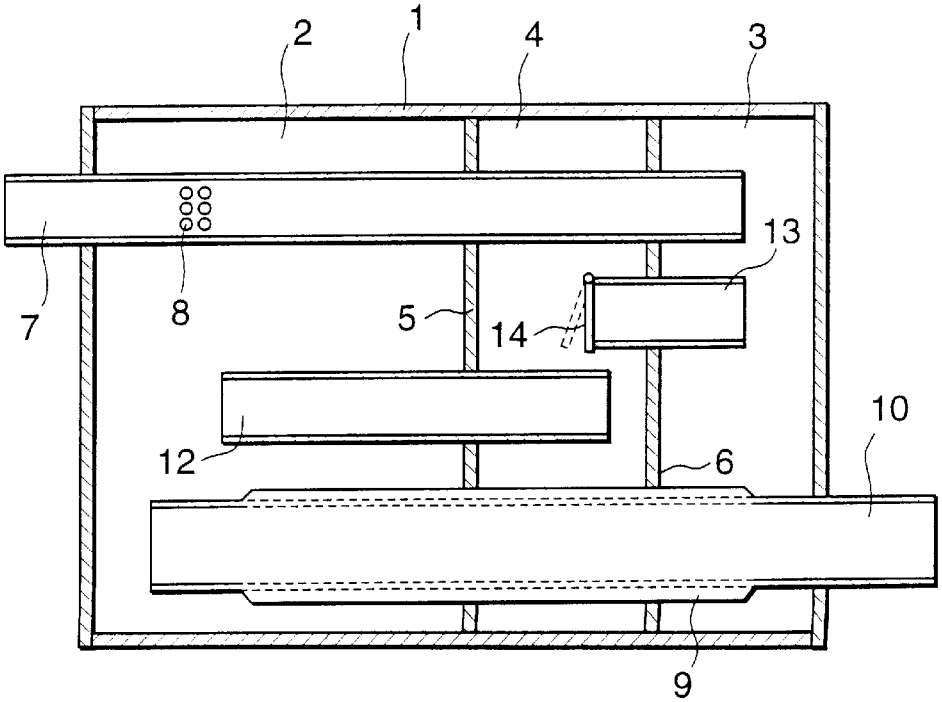
FIG. 6 is a sectional view of an exhaust noise suppressor according to a third embodiment of this invention.

FIG. 6 shows a third embodiment of this invention.

In this embodiment, the positions of the first volume chamber 3 and the second volume chamber 4 are reversed compared to the aforesaid first embodiment. As the first and second paths have identical configurations to those of the first embodiment, the same desirable muffling effect is obtained as in the first embodiment.

Figure 7:
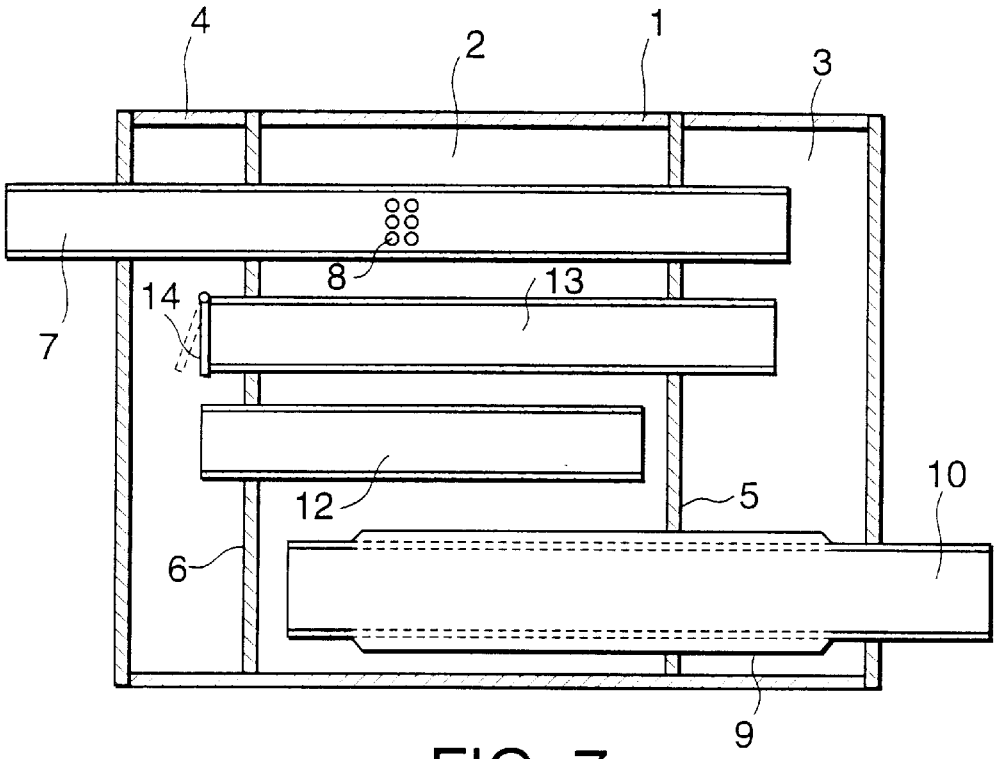
FIG. 7 is a longitudinal sectional view of an exhaust noise suppressor according to a fourth embodiment of this invention.

FIG. 7 shows a fourth embodiment of this invention.

According to this embodiment, the muffler 1 is partitioned in the sequence, second volume chamber 4, expansion chamber 2 and first volume chamber 3 from the left of the figure. As the first and second paths have identical configurations to those of the aforesaid first embodiment, the same desirable muffling effect is obtained as in the first embodiment.

According to this embodiment, the connecting tube 13 which passes; through the second expansion chamber 2 is longer than in the aforesaid first and third embodiments, so reduction of exhaust noise in the high rotation speed region is further enhanced.

Figure 8:
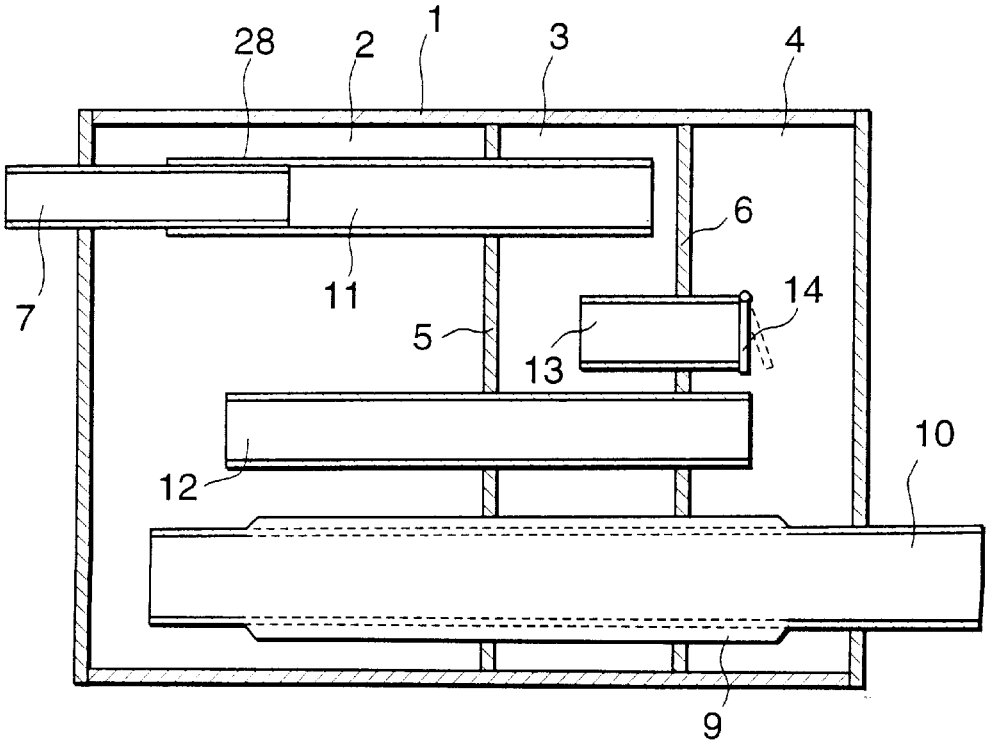
FIG. 8 is a longitudinal sectional view of an exhaust noise suppressor according to a fifth embodiment of this invention.

FIG. 8 shows a fifth embodiment of this invention.

The construction of each chamber in the muffler 1 in this embodiment is the same as in the aforesaid first embodiment.

Instead of providing the small holes 8 in the tail tube 7, the end of the tail tube 7 is inserted in a pipe 11 of larger diameter. The pipe 11 passes through the baffle plate 5, and opens into the first volume chamber 3. A gap 28 is allowed between the inlet tube 7 and pipe 11.

In this embodiment, as the first and second paths have identical configurations to those of the first embodiment, the same desirable muffling effect is obtained as in the first embodiment.

According g to th is embodiment, as the pipe 11 is independent from the inlet tube 7, the length and diameter of the pipe 11 can be made larger, and muffling performance at low frequencies is thereby improved.

Figure 9:
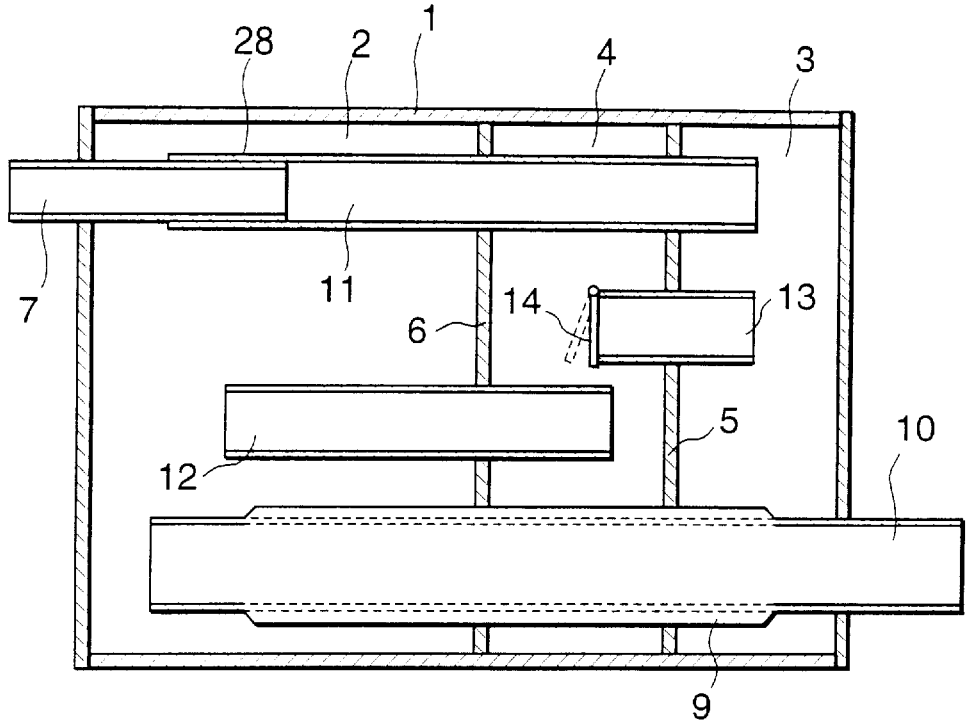
FIG. 9 is a longitudinal sectional view of an exhaust noise suppressor according to a sixth embodiment of this invention.

FIG. 9 shows a sixth embodiment of this invention.

This embodiment resembles the aforesaid third embodiment, but as in the case of the aforesaid fifth embodiment, one end of the tail tube 7 is inserted in the pipe 11 of large diameter.

Figure 10:
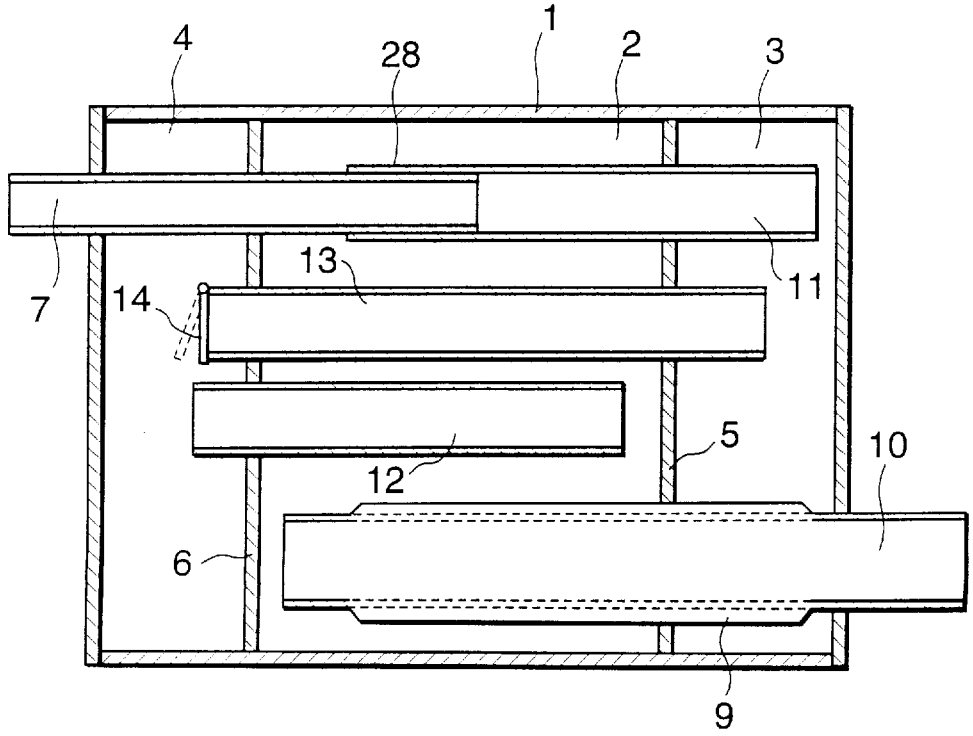
FIG. 10 is a longitudinal sectional view of an exhaust noise suppressor according to a seventh embodiment of this invention.

FIG. 10 shows a seventh embodiment of this invention.

This embodiment resembles the aforesaid fourth embodiment, but as in the case of the aforesaid fifth embodiment, one end of the tail tube 7 is inserted in the pipe 11 of large diameter.

Figure 11:
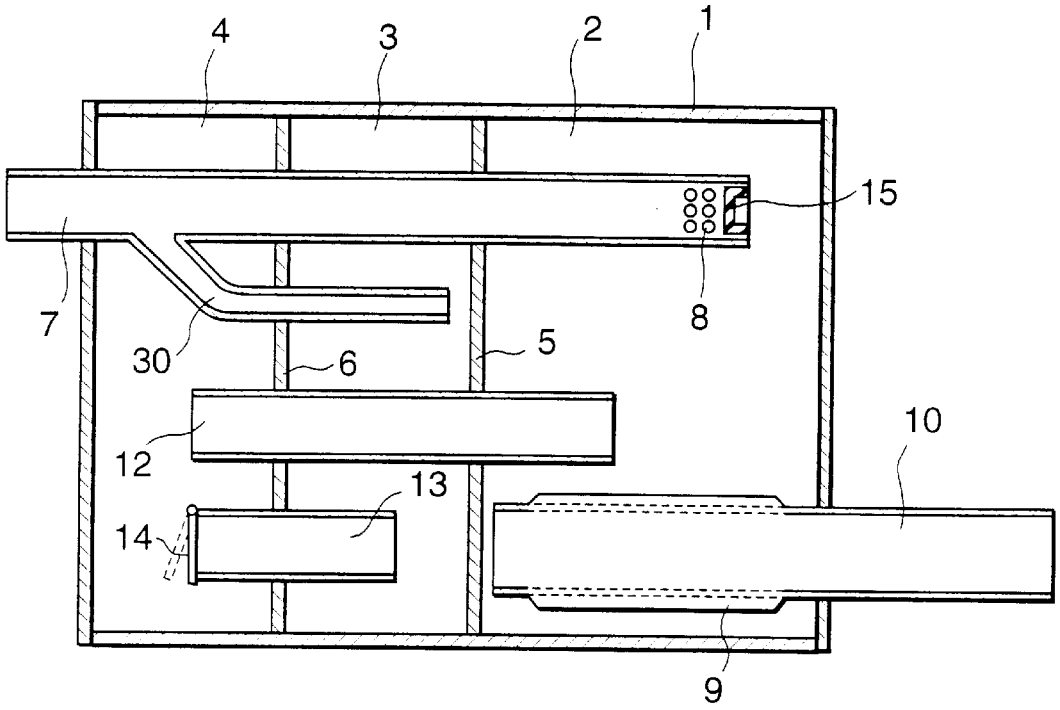
FIG. 11 is a longitudinal sectional view of an exhaust noise suppressor according to an eighth embodiment of this invention.

FIG. 11 shows an eighth embodiment of this invention.

The inside area of the muffler 1 in this embodiment is partitioned in the sequence, second expansion chamber 4, first volume chamber 3 and expansion chamber 2 starting from the left of the figure.

The inlet tube 7 passes through the second expansion chamber 4 and first volume chamber 3, and reaches the expansion chamber 2. The end of the inlet tube 7 in the expansion chamber 2 is closed by a plug 15, the inlet tube 7 being connected to the expansion chamber 2 via the numerous small holes 8.

The inlet tube 7 is also connected to the first volume chamber 3 by a branch pipe 30.

As the first and second paths have identical configurations to those of the first embodiment, the same desirable muffling effect is obtained as in the first embodiment.

According to this embodiment, the length and diameter of the branch pipe 30 may be freely set, so low frequency muffling characteristics are improved.

Figure 12:
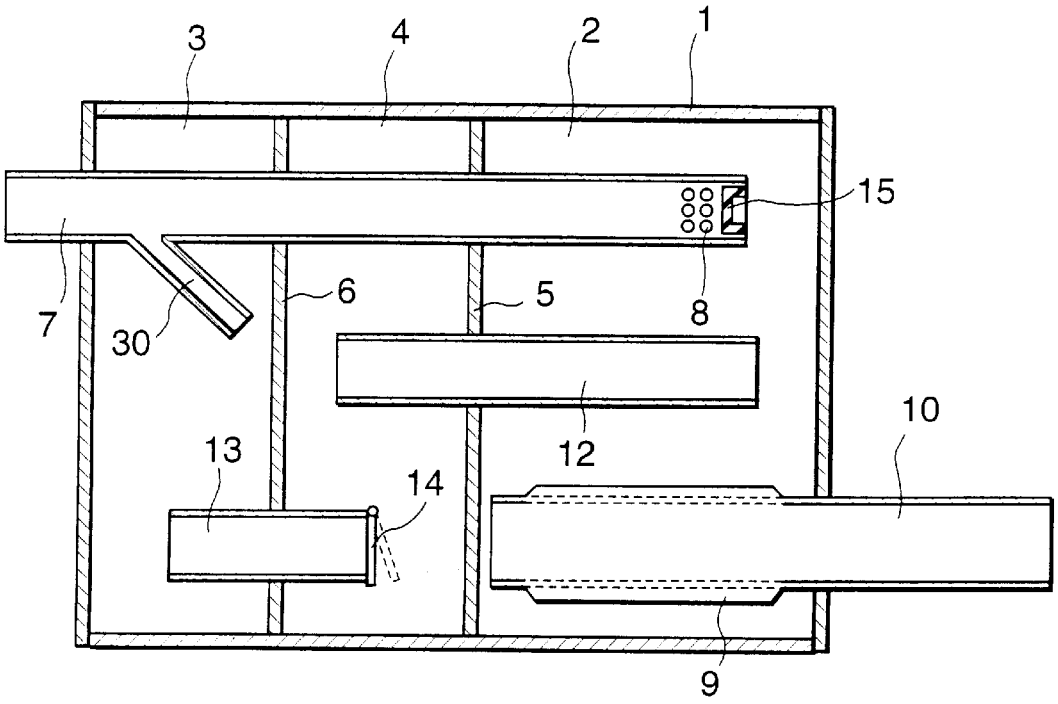
FIG. 12 is a longitudinal sectional view of an exhaust noise suppressor according to a ninth embodiment of this invention.

FIG. 12 shows a ninth embodiment of this invention.

In this embodiment, the second volume chamber 4 is arranged between the first volume chamber 3 and the expansion chamber 2. The same desirable muffling effect is obtained in this embodiment as in the eighth embodiment.

Figure 13:
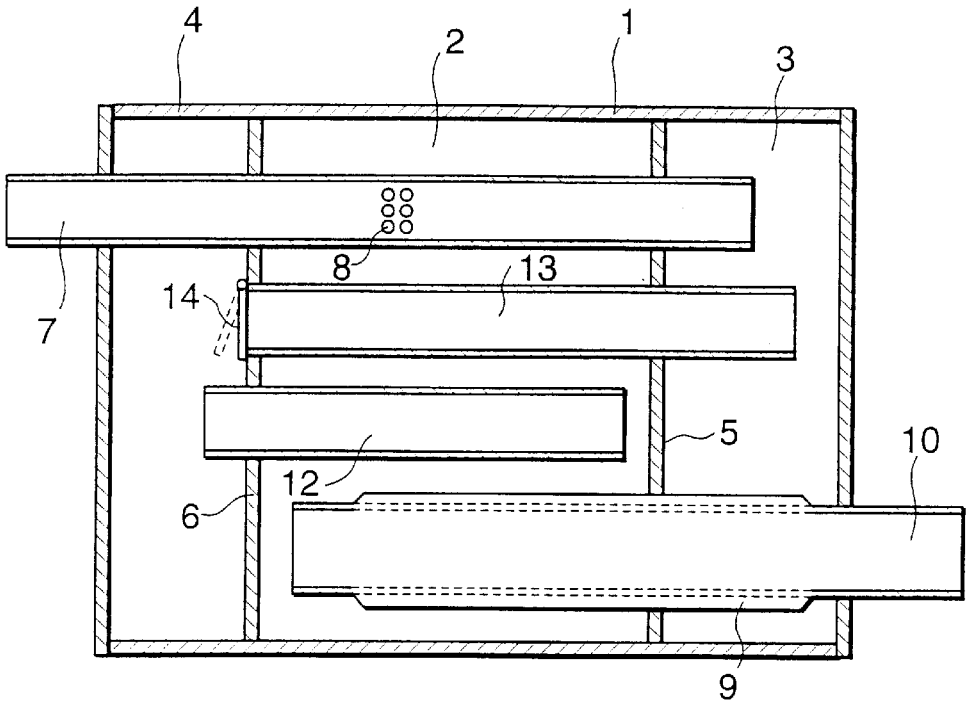
FIG. 13 is a longitudinal sectional view of an exhaust noise suppressor according to a tenth embodiment of this invention.
Figure 14:
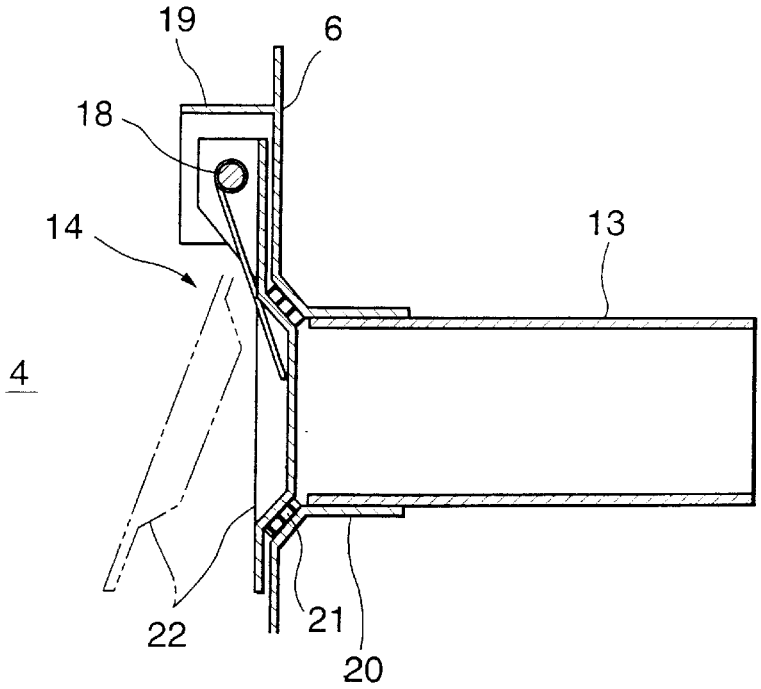
FIG. 14 is a longitudinal sectional view of a valve according to the tenth embodiment.

FIGS. 13 and 14 show a tenth embodiment of this invention.

This embodiment resembles the aforesaid fourth embodiment, only the construction of the valve 14 being different.

Unlike the first and second embodiments, the valve seat 20 of the valve 14 is formed in a one-piece construction with the baffle plate 6, as shown in FIG. 14. The annular pad 21 in contact with the valve body 22 is provided in the valve seat 20, and the bracket 19 supporting the axis 18 is fixed to the baffle plate 6, e.g. by welding.

In this way, the valve seat 20 is formed in a one-piece construction with the baffle plate 6, so the number of parts Is reduced and the noise suppressor can be made lightweight.

Figure 15:
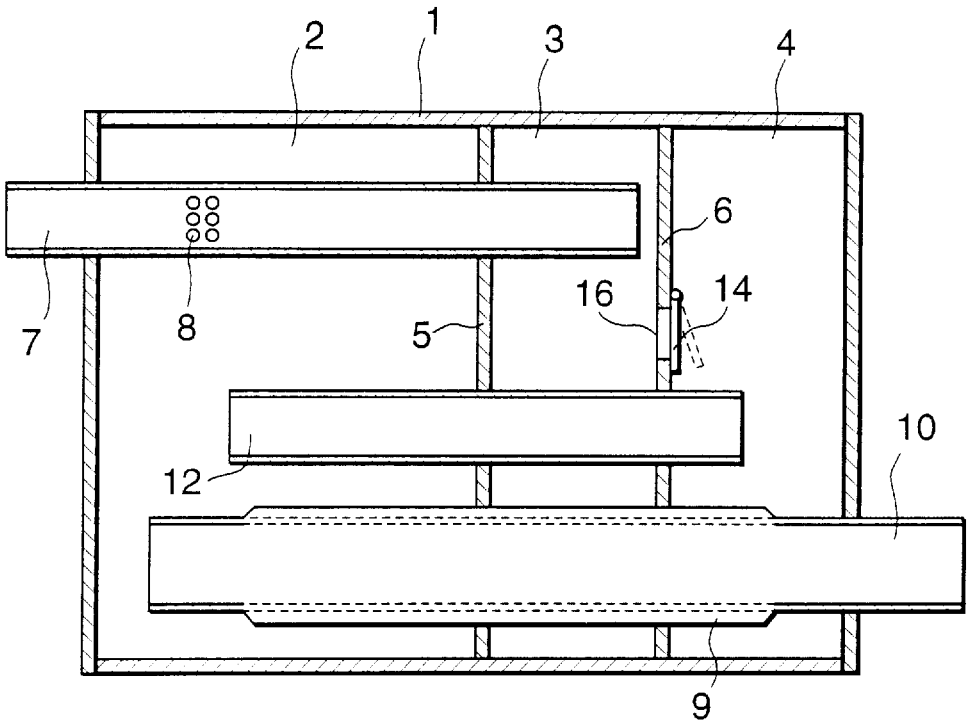
FIG. 15 is a longitudinal sectional view of an exhaust noise suppressor according to an eleventh embodiment of this invention.
Figure 16:
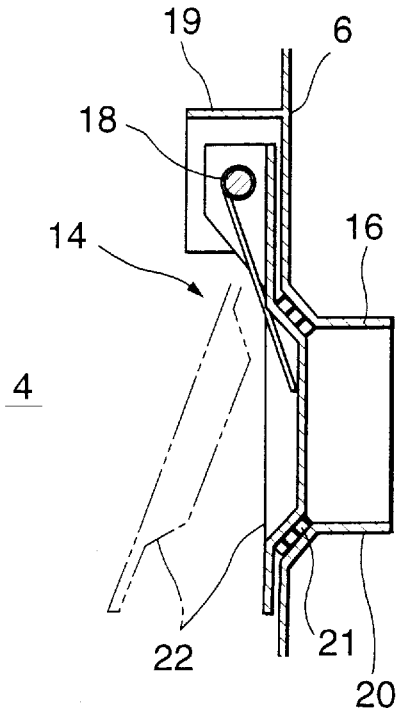
FIG. 16 is a longitudinal sectional view of a valve according to the eleventh embodiment.

FIGS. 15 and 16 show an eleventh embodiment of this invention.

This embodiment resembles the aforesaid first embodiment, but instead of the connecting tube 13, an opening 16 is formed in the baffle plate 6, and a valve 14 is provided to open and close the opening 16.

The valve 14 comprises the valve seat 20 formed in a one-piece construction with the baffle plate 6 as shown in FIG. 16, and the cylindrical opening 16 is formed continuously with this valve seat 20. The remaining features of the construction of the valve 14 are the same as those of the aforesaid tenth embodiment. By forming the valve 14 in this way, the number of parts is reduced and the noise suppressor can be made lightweight.

Figure 17:
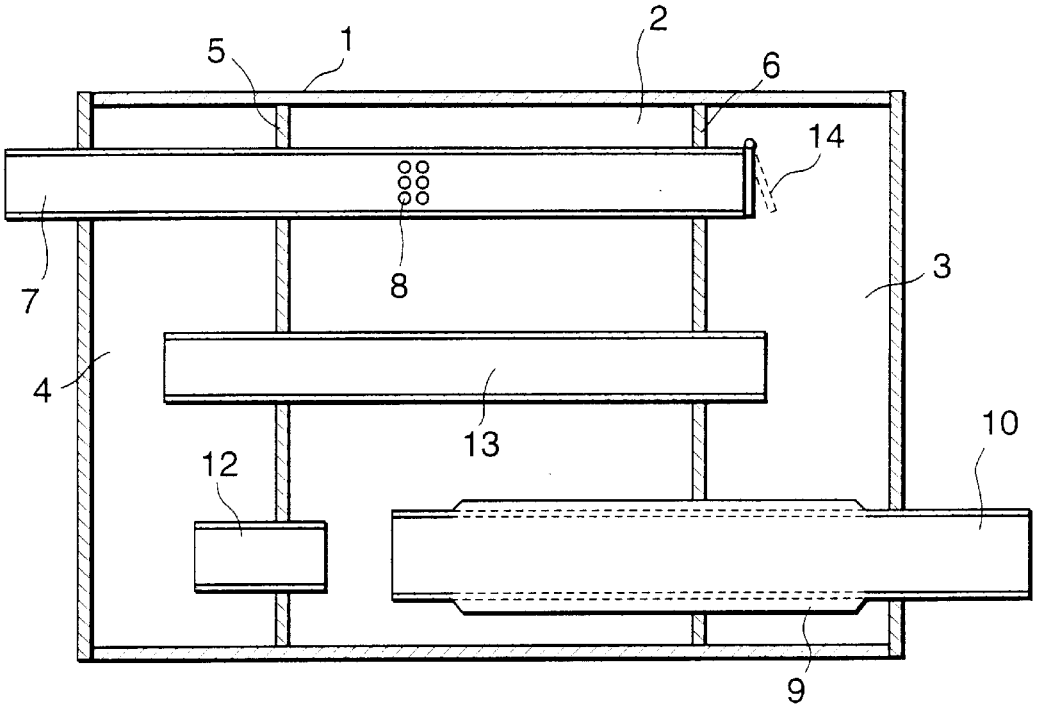
FIG. 17 is a longitudinal sectional view of an exhaust noise suppressor according to a twelfth embodiment of this invention.

FIG. 17 shows a twelfth embodiment of this invention.

This embodiment resembles the aforesaid fourth embodiment, but instead of providing the valve 14 in the connecting tube 13, the valve 14 is attached to the end of the inlet tube 7.

The valve 14 may for example have an identical construction as that of the aforesaid first embodiment, but the end of inlet tube 7 fits into the inner circumference of the valve seat 20 instead of the connecting tube 13.

According to this embodiment, when the valve 14 opens due to exhaust. pressure at high engine rotation speeds, the same first path and second path are formed as in the aforesaid first embodiment. Therefore the same desirable muffling effect is obtained as in the aforesaid first embodiment.

According to this embodiment, the first volume chamber 3 is permanently connected with the second volume chamber 4 via the connecting tube 13. As a result, two resonators comprising the first volume chamber 3 and the second volume chamber 4 are connected in series to the expansion chamber 2 at low engine rotation speeds when the valve 14 is closed, so particularly good muffling performance is obtained at these low engine speeds and exhaust "stuttering" in the passenger compartment of the vehicle is reduced.

Figure 18:
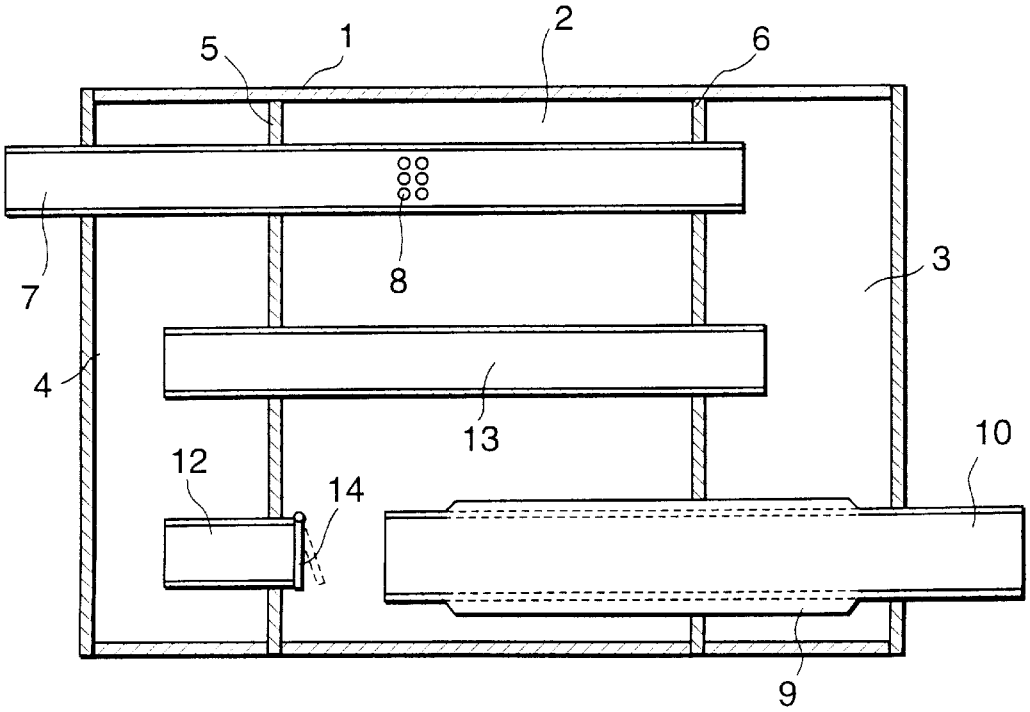
FIG. 18 is a longitudinal sectional view of an exhaust noise suppressor according to a thirteenth embodiment of this invention.

FIG. 18 shows a thirteenth embodiment of this invention.

This embodiment resembles the aforesaid twelfth embodiment, but instead of providing the valve 14 in the inlet tube 7, the valve 14 is provided in the connecting tube 12. According also to this embodiment, the same desirable muffling effect is obtained as in the twelfth embodiment.

Figure 19:
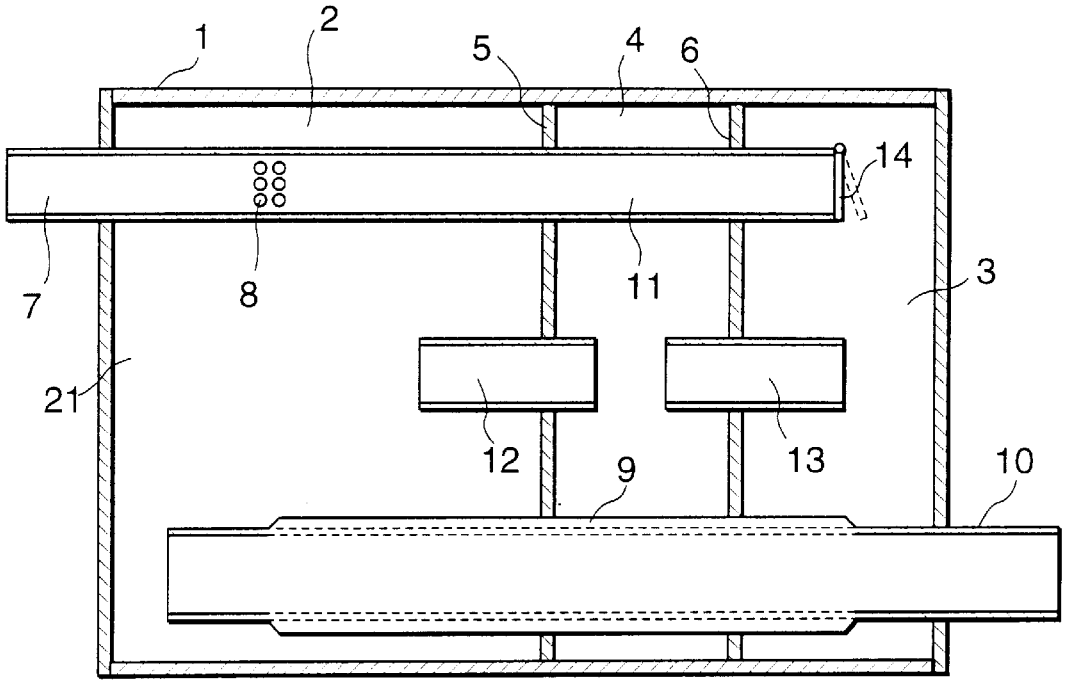
FIG. 19 is a longitudinal sectional view of an exhaust noise suppressor according to a fourteenth embodiment of this invention.

FIG. 19 shows a fourteenth embodiment of this invention.

This embodiment resembles the third embodiment, but instead of providing the valve 14 in the connecting tube 13, the valve 14 is provided at the end of the inlet tube 7. According also to this embodiment, the same desirable muffling effect is obtained as in the third embodiment.

According to this embodiment, the first volume chamber 3 is permanently connected with the second volume chamber 4 via the connecting tube 13 as in the case of the aforesaid twelfth embodiment. Hence, particularly good muffling performance is obtained with regard to low frequency noise at low engine rotation speeds.

Figure 20:
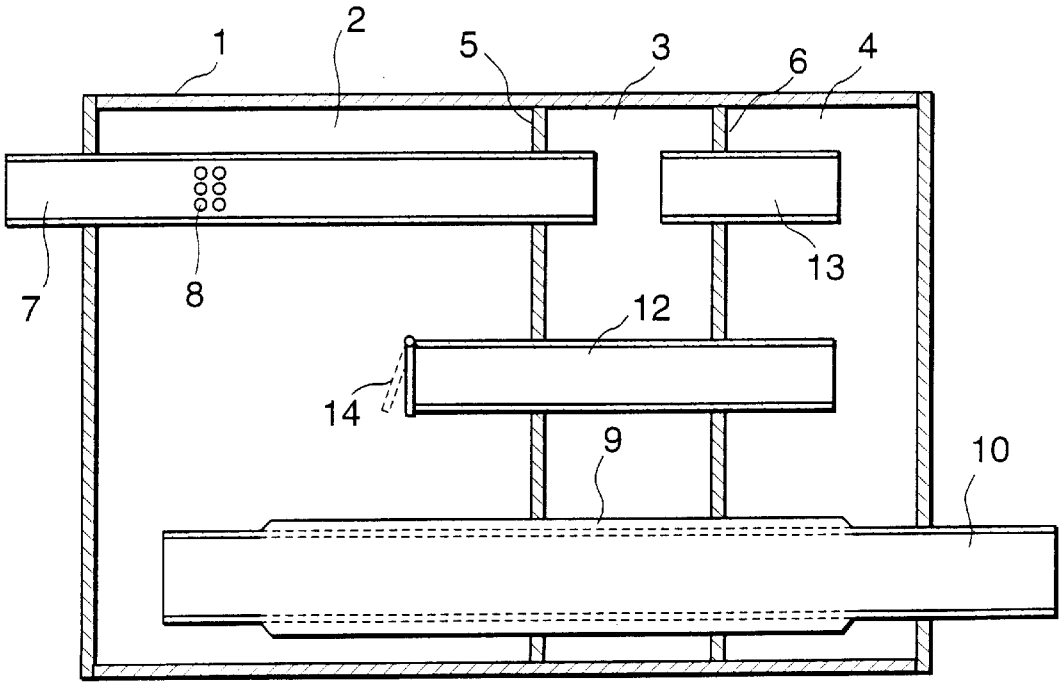
FIG. 20 is a longitudinal sectional view of an exhaust noise suppressor according to a fifteenth embodiment of this invention.

FIG. 20 shows a fifteenth embodiment of this invention.

This embodiment resembles the aforesaid first embodiment, but instead of providing the valve 14 in the connecting tube 13, the valve 14 is provided in the connecting tube 12.

In this embodiment also, the same desirable muffling effect is obtained as in the first embodiment.

According to this embodiment, the first volume chamber 3 is permanently connected with the second volume chamber 4 via the connecting tube 13 as in the case of the aforesaid twelfth embodiment. Hence, particularly good muffling performance is obtained with regard to low frequency noise at low engine rotation speeds when the valve 14 is closed.

Figure 21:
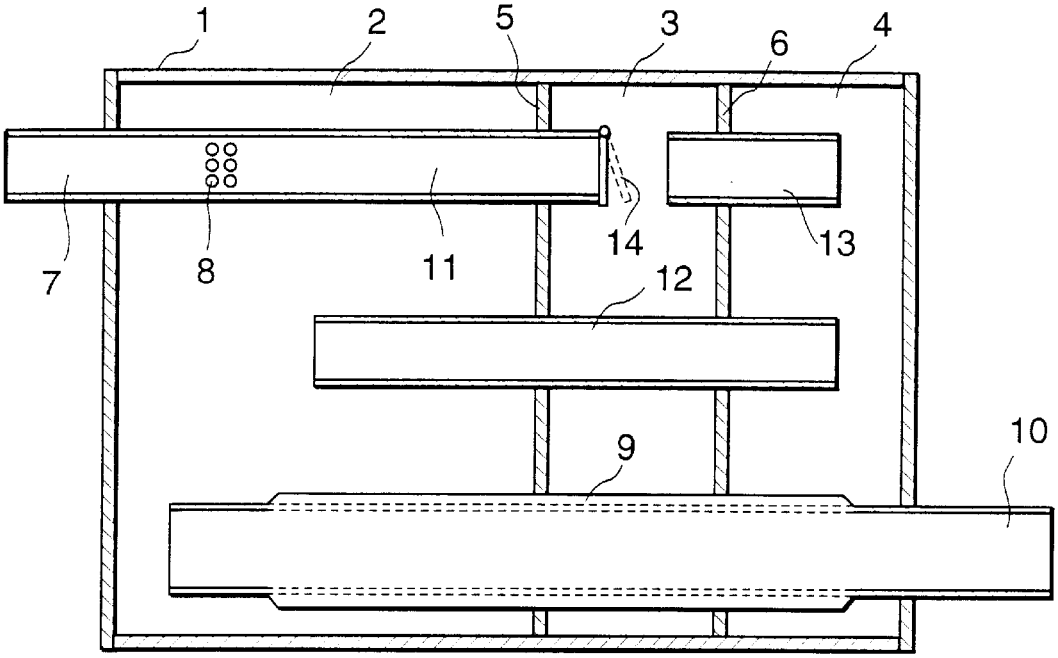
FIG. 21 is a longitudinal sectional view of an exhaust noise suppressor according to a sixteenth embodiment of this invention.

FIG. 21 shows a sixteenth embodiment of this invention.

This embodiment resembles the aforesaid fifteenth embodiment, but instead of providing the valve 14 in the connecting tube 12, the valve 14 is provided at the end of the inlet tube 7.

According also to this embodiment, the same desirable muffling effect is obtained as in the fifteenth embodiment. According to this embodiment, the connecting tube 12 forming part of a first stage resonator is longer than the connecting tube 13 forming part of a second stage resonator relative to the expansion chamber 2 when the valve 14 is closed. It is therefore possible to set the muffling frequency of these resonators which are connected together, to lower frequency.

Figure 22:
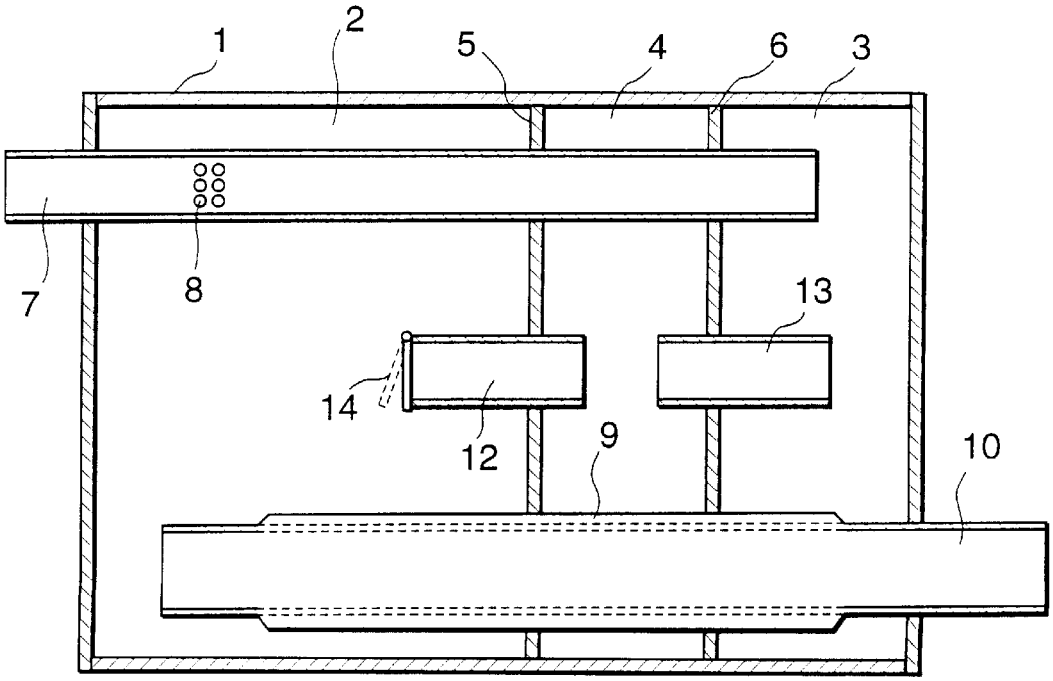
FIG. 22 is a longitudinal sectional view of an exhaust noise suppressor according to a seventeenth embodiment of this invention.

FIG. 22 shows a seventeenth embodiment of this invention.

This embodiment resembles the aforesaid fourteenth embodiment, but instead of providing the valve 14 in the inlet tube 7, the valve 14 is provided in the connecting tube 12.

According also to this embodiment, the same desirable muffling effect is obtained as in the fourteenth embodiment.

Figure 23:
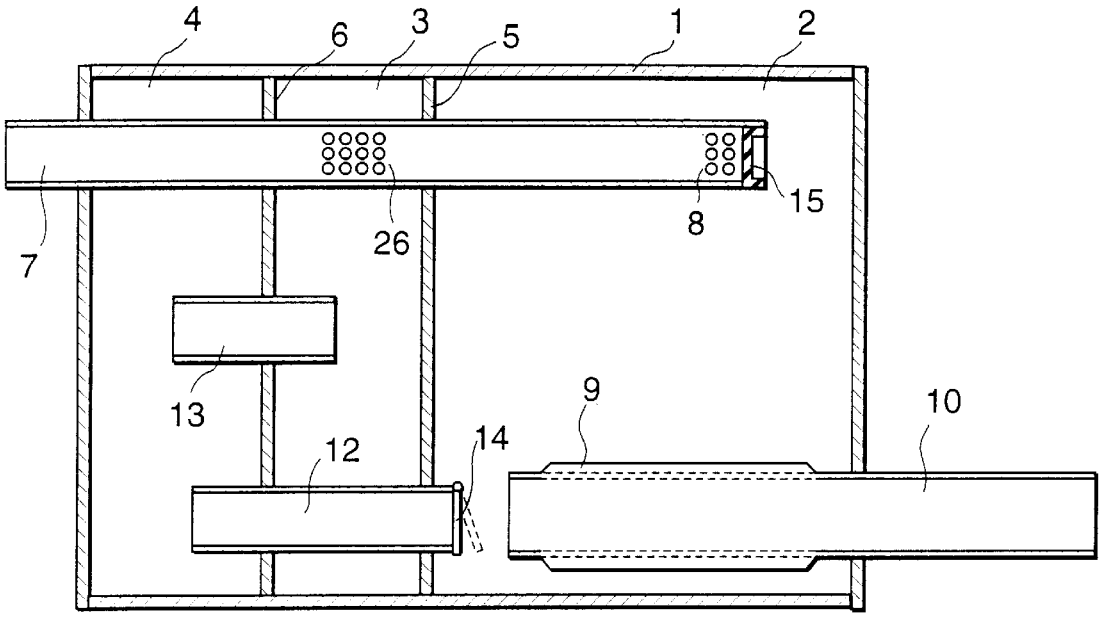
FIG. 23 is a longitudinal sectional view of an exhaust noise suppressor according to an eighteenth embodiment of this invention.

FIG. 23 shows an eighteenth embodiment of this invention.

The inner area of the muffler 1 in this embodiment is partitioned in the sequence, second expansion chamber 4, first volume chamber 3 and expansion chamber 2 starting from the left of the figure as in the case of the aforesaid eighth embodiment.

In addition to the small holes 8 which open into the expansion chamber 2, numerous small holes 26 are formed in the inlet tube 7 which open into the first volume chamber 3. The valve 14 is provided in the connecting tube 12.

In this embodiment, as the first and second paths have identical configurations to those of the first embodiment, the same desirable muffling effect is obtained as in the first embodiment.

According to this embodiment, the first volume chamber 3 is permanently connected with the second volume chamber 4 via the connecting tube 13. Hence, particularly good muffling performance is obtained with regard to low frequency noise at low engine rotation speeds when the valve 14 is closed.

Figure 24:
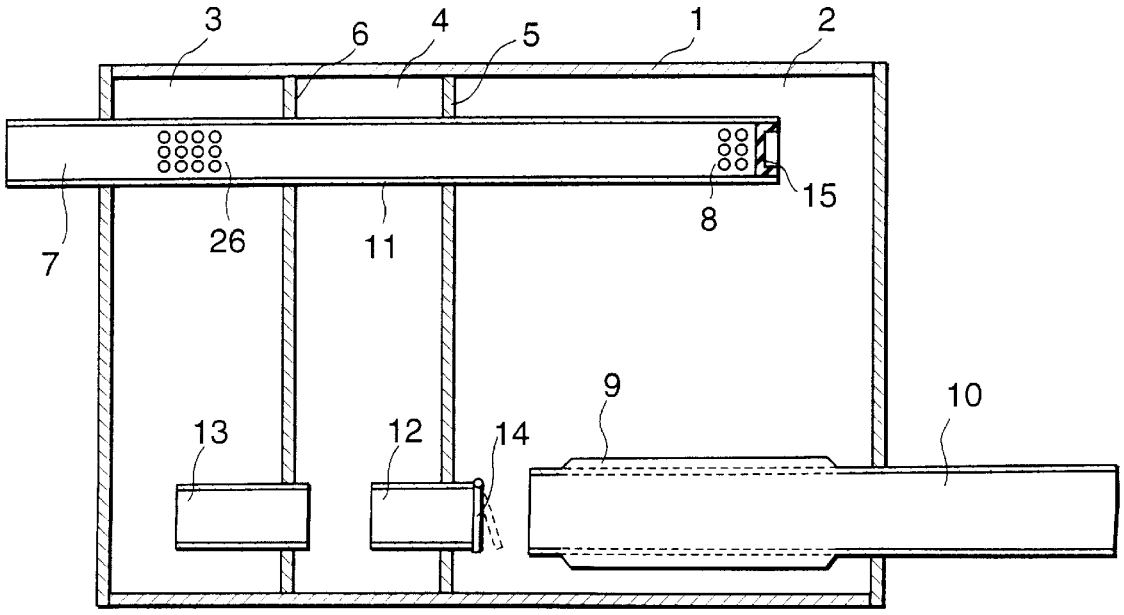
FIG. 24 is a longitudinal sectional view of an exhaust noise suppressor according to a nineteenth embodiment of this invention.

FIG. 24 shows a nineteenth embodiment of this invention.

The inner area of the muffler 1 in this embodiment is partitioned in the sequence, first volume chamber 3, second volume chamber 4 and expansion chamber 2 starting from the left of the figure as in the case of the aforesaid ninth embodiment.

In addition to the small holes 8 which open into the expansion chamber 2, numerous small holes 26 are formed in the inlet tube 7 which open into the first volume chamber 3. Also, the connecting tubes 12, 13 and the tail tube 10 are disposed coaxially, and the valve 14 is provided in the connecting tube 12.

In this embodiment, the same desirable muffling effect is obtained as in the aforesaid eighteenth embodiment. Moreover as the connecting tubes 12, 13 are disposed coaxially with the tail tube 10, in the high engine rotation speed region, exhaust gas in the first volume chamber 3 is discharged by flowing straight through the connecting tubes 13, 12 and tail tube 10, so exhaust pressure losses are reduced.

Figure 25:
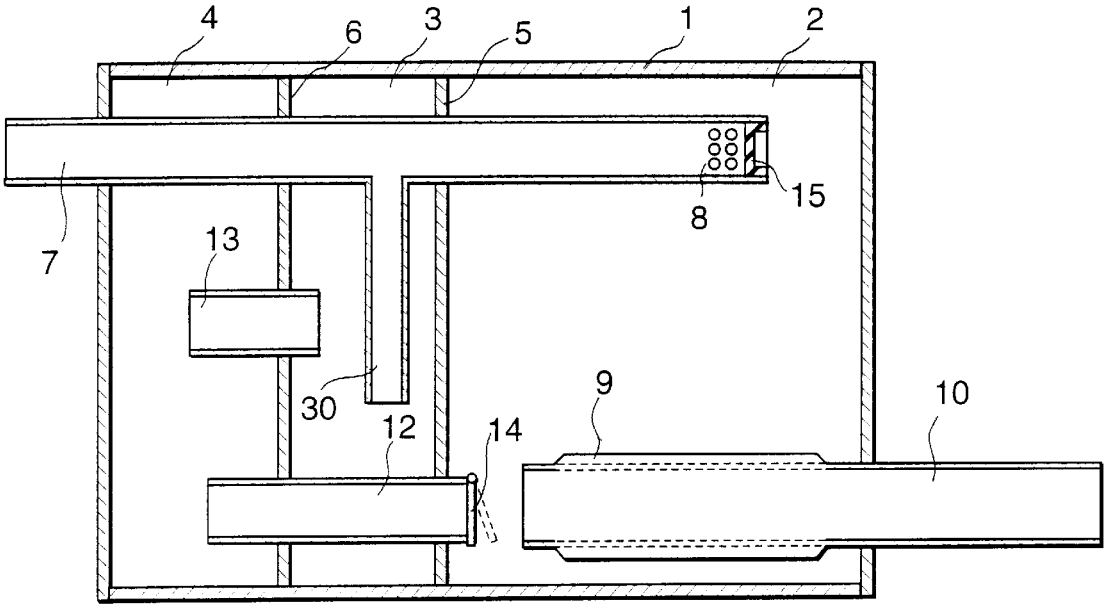
FIG. 25 is a longitudinal sectional view of an exhaust noise suppressor according to a twentieth embodiment of this invention.

FIG. 25 shows a twentieth embodiment of this invention.

This embodiment resembles the aforesaid eighteenth embodiment, but the first inlet tube 7 is connected to the volume chamber 3 via the branch pipe 30 instead of the small holes 26.

In this embodiment, the same desirable muffling effect is obtained as that of the aforesaid eighteenth embodiment. Further, the length and diameter of the branch pipe 30 can be freely set, so low frequency noise muffling characteristics are improved.

Figure 26:
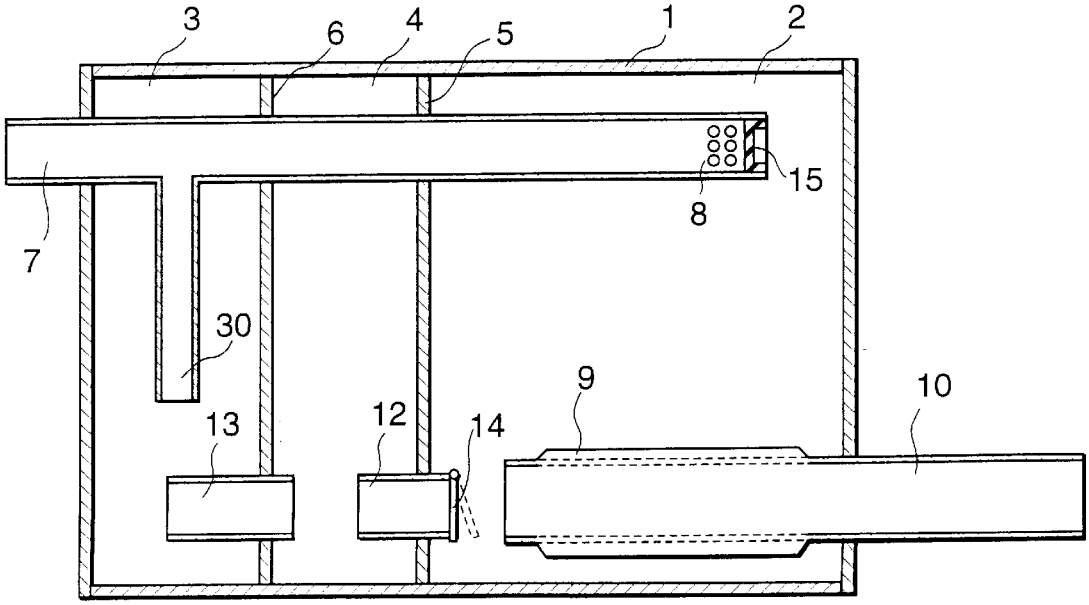
FIG. 26 is a longitudinal sectional view of an exhaust noise suppressor according to a twenty-first embodiment of this invention.

FIG. 26 shows a twenty-first embodiment of this invention.

This embodiment resembles the aforesaid nineteenth embodiment, but the first inlet tube 7 is connected to the volume chamber 3 via the branch pipe 30 instead of the small holes 26.

In this embodiment, the same desirable muffling effect as that of the aforesaid nineteenth embodiment is obtained. As the length and diameter of the branch pipe 30 can be freely set, low frequency muffling characteristics are enhanced.

Figure 27:
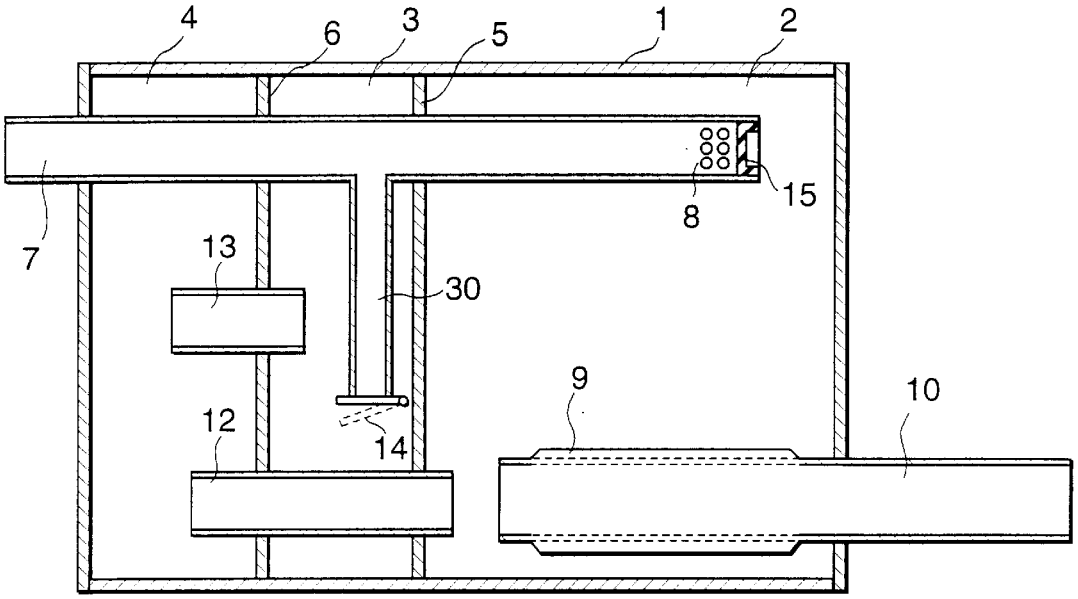
FIG. 27 is a longitudinal sectional view of an exhaust noise suppressor according to a twenty-second embodiment of this invention.

FIG. 27 shows a twenty-second embodiment of this invention.

This embodiment resembles the aforesaid twentieth embodiment, but instead of providing the valve 14 in the connecting tube 12, the valve 14 is attached to the branch pipe 30.

In this embodiment, a desirable muffling effect due to two resonators connected in series is obtained at low engine rotation speeds when the valve 14 is closed, and a desirable muffling effect due to two paths as in the aforesaid first embodiment is obtained at high engine rotation speeds when the valve 14 is open. Also, the length and diameter of the branch pipe 30 can be freely set, so low frequency muffling characteristics are improved.

Figure 28:
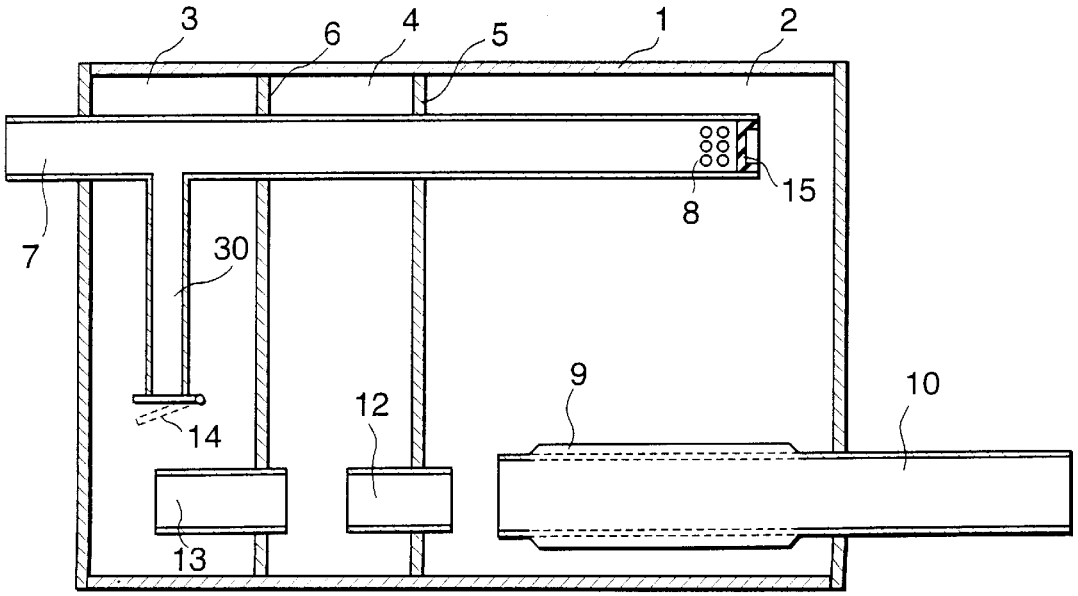
FIG. 28 is a longitudinal sectional view of an exhaust noise suppressor according to a twenty-third embodiment of this invention.

FIG. 28 shows a twenty-third embodiment of this invention.

This embodiment resembles the aforesaid twenty-first embodiment, but instead of providing the valve 14 in the connecting tube 12, the valve 14 is provided in the branch pipe 30.

In this embodiment, a desirable muffling effect due to two resonators connected in series is obtained at low engine rotation speeds when the valve 14 is closed, and a desirable muffling effect due to two paths as in the aforesaid first embodiment is obtained at high engine rotation speeds when. the valve 14 is open. The length and diameter of the branch pipe 30 can be freely set, so low frequency muffling characteristics are improved. Also, exhaust pressure losses can be reduced at high engine rotation speeds as in the aforesaid nineteenth embodiment.

Figure 29:
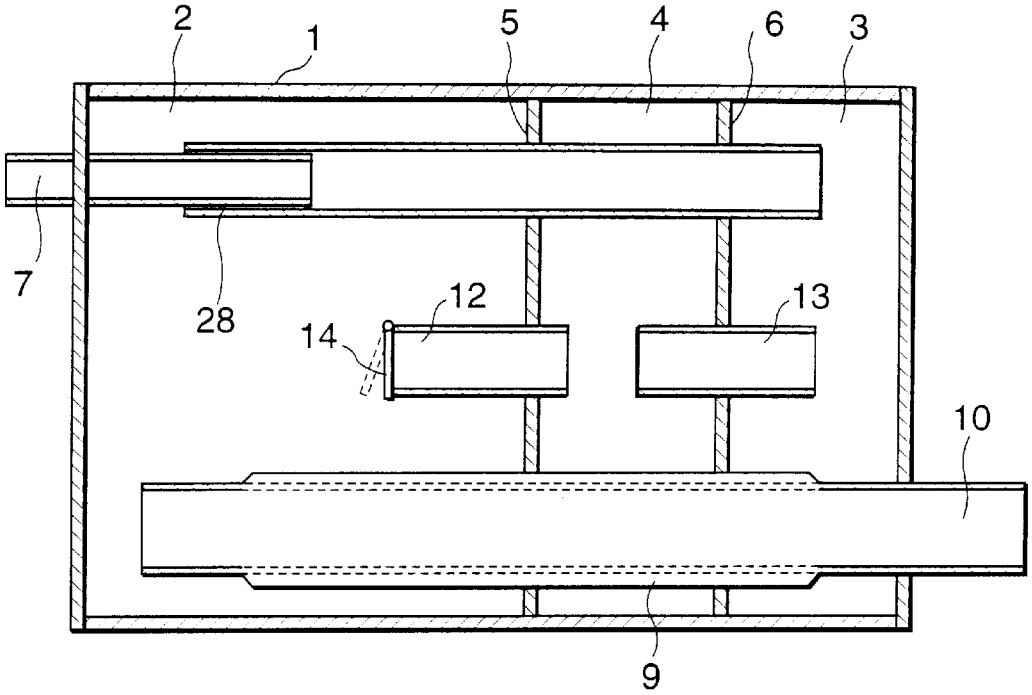
FIG. 29 is a longitudinal sectional view of an exhaust noise suppressor according to a twenty-fourth embodiment of this invention.

FIG. 29 shows a twenty-fourth embodiment of this invention.

This embodiment resembles the aforesaid sixth embodiment, but instead of providing the valve 14 in the connecting tube 13, the valve 14 is provided in the connecting tube 12.

In this embodiment, the same desirable muffling effect as that of the aforesaid sixth embodiment is obtained. Also, as the first volume chamber 3 is permanently connected with the second volume chamber 4 via the connecting tube 13, the two resonators comprising the volume chambers 3, 4 are connected in series with the expansion chamber 2 at low engine rotation speeds, so particularly good muffling performance is obtained with regard to low frequency noise.

Figure 30:
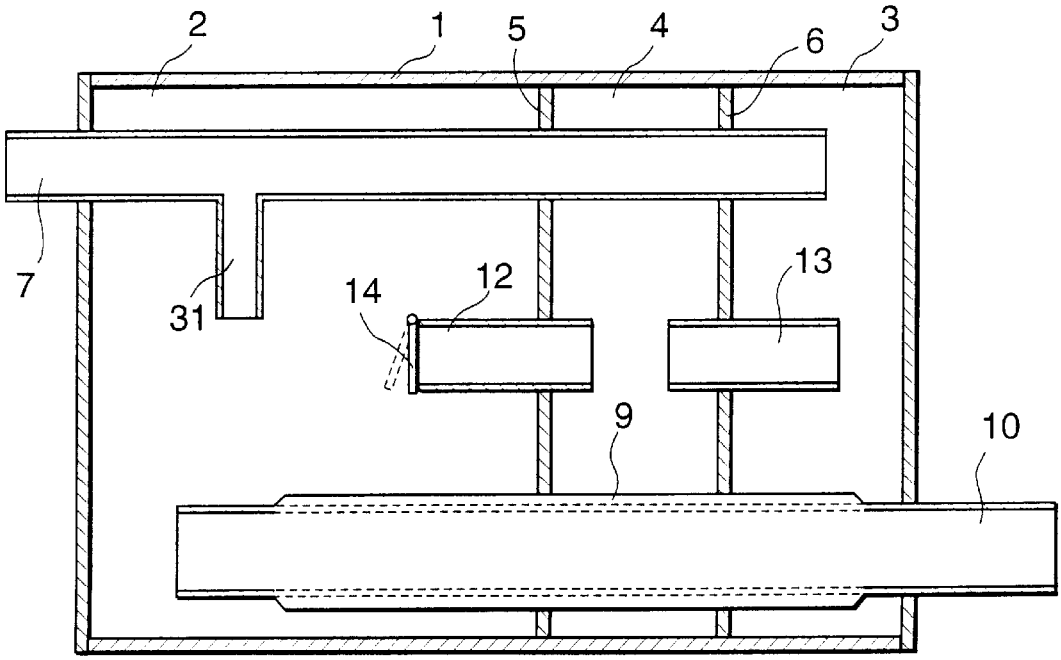
FIG. 30 is a longitudinal sectional view of an exhaust noise suppressor according to a twenty-fifth embodiment of this invention.

FIG. 30 shows a twenty-fifth embodiment of this invention.

This embodiment resembles the aforesaid seventeenth embodiment, but instead of the small holes 8, the inlet tube 7 is connected to the expansion chamber 2 via a branch pipe 31.

In this embodiment, in addition to the muffling characteristics of the aforesaid seventeenth embodiment, the length and diameter of the branch pipe 31 can be freely set, so low frequency muffling characteristics are further enhanced.

Figure 31:
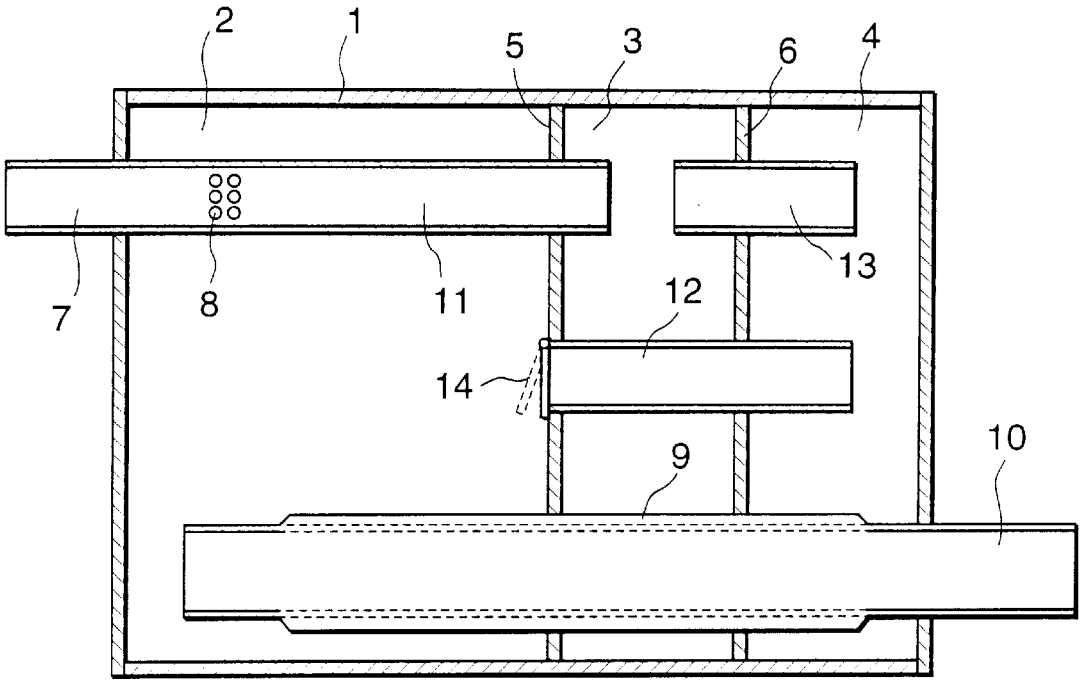
FIG. 31 is a longitudinal sectional view of an exhaust noise suppressor according to a twenty-sixth embodiment of this invention.

FIG. 31 shows a twenty-sixth embodiment of this invention.

This embodiment resembles the aforesaid first embodiment, but instead of providing the valve 14 in the connecting tube 13, the valve 14 is provided in the connecting tube 12. For example, the valve 14 of the aforesaid tenth embodiment may be used as the valve 14 in this embodiment.

In this embodiment, the same desirable muffling effect as that of the aforesaid first embodiment is obtained. As the first volume chamber 3 and second volume chamber 4 are permanently connected via the connecting tube 13, the two resonators comprising these volume chambers 3, 4 are connected in series with the expansion chamber 2 at low engine rotation speeds, so a good muffling effect is obtained particularly with respect to low frequency noise. Further, as the valve seat 20 of the valve 14 is formed in a one-piece construction with the baffle plate 5, the number of parts can be reduced, and the noise suppressor can be made lightweight.

Figure 32:
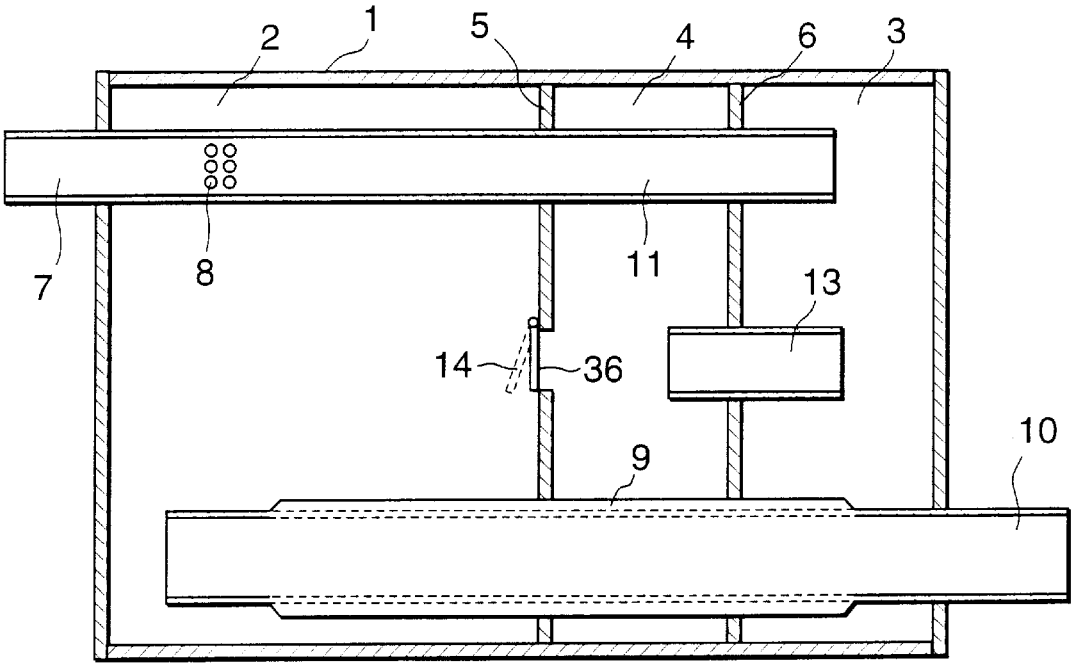
FIG. 32 is a longitudinal sectional view of an exhaust noise suppressor according to a twenty-seventh embodiment of this invention.

FIG. 32 shows a twenty-seventh embodiment of this invention.

This embodiment resembles the aforesaid seventeenth embodiment, but instead of the connecting tube 12, an opening 36 is formed in the baffle plate 5 and the valve 14 is attached to the opening 36.

The construction of the valve 14 is similar to that of the aforesaid eleventh embodiment.

In this embodiment, the same muffling effect as that of the aforesaid seventeenth embodiment is obtained, and by forming the valve 14 as in the aforesaid eleventh embodiment, the number of parts can be reduced and the noise suppressor can be made lightweight.

The noise suppressor described in any of the aforesaid embodiments may be used with any of the valves 14 described in the aforesaid first, second, tenth and eleventh embodiments in any desired combination. For example, the valve of the tenth embodiment may be applied to the noise suppressor of the first embodiment.

The embodiments of this invention in which an exclusive property or privilege is claimed are defined as follows:

1. An exhaust noise suppressor for use with an engine, comprising:

a muffler whereof the inner area is partitioned into an expansion chamber, a first volume chamber and a second volume chamber, an inlet tube for leading engine exhaust gas into said expansion chamber, said inlet tube having an orifice of a first area, said orifice being directly connected to said expansion chamber, a tail tube for discharging exhaust gas of said expansion chamber outside said muffler, a first passage connecting said inlet tube and said first volume chamber, said first passage having an opening of a second area greater than said first area, a second passage connecting said first volume chamber and said second volume chamber, a third passage connecting said second volume chamber and said expansion chamber, a valve for blocking a flow of exhaust gas travelling from said inlet tube to said expansion chamber via said first passage, said second passage and said third passage, said valve actuating in response to creation of a threshold pressure differential between the flow travelling through said first area and the flow travelling through said second area.

2. An exhaust noise suppressor as defined in claim 1, wherein said first volume chamber and second volume chamber form a resonator connected in parallel with said expansion chamber.

3. An exhaust noise suppressor as defined in claim 1, wherein said first volume chamber and said second volume chamber form a resonator connected in series with said expansion chamber.

4. An exhaust noise suppressor as defined in claim 1, wherein said orifice of said inlet tube comprises small holes formed in said inlet tube in said expansion chamber, and said first passage is formed by a downstream part of said inlet tube situated further downstream than said small holes.

5. An exhaust noise suppressor as defined in claim 1, wherein said first passage is formed by a pipe fitted such that a gap is left between said pipe and said inlet tube in said expansion chamber said orifice being defined by said gap.

6. An exhaust noise suppressor as defined in claim 1, wherein said second volume chamber is arranged between said expansion chamber and said first volume chamber, and said first passage passes through said second volume chamber.

7. An exhaust noise suppressor as defined in claim 1, wherein said expansion chamber is arranged between said second volume chamber and said first volume chamber, and said second passage is formed by a pipe passing through said expansion chamber.

8. An exhaust noise suppressor as defined in claim 1, wherein said first volume chamber and said second volume chamber are partitioned by a baffle plate, said second passage is formed by a pipe passing through said baffle plate, and said valve comprises a valve seat provided in an opening of said pipe which extends from said baffle plate, a valve body which can seat in said valve seat for closing said opening of said pipe, and a spring for pushing said valve body towards a seated position.

9. An exhaust noise suppressor as defined in claim 8, wherein said valve further comprises a bracket for supporting said valve body free to pivot, said bracket being formed in a one-piece construction with said valve seat.

10. An exhaust noise suppressor as defined in claim 8, wherein said valve further comprises a bracket for supporting said valve body free to pivot, said bracket being formed in a one-piece construction with said baffle plate.

11. An exhaust noise suppressor as defined in claim 1, wherein said first volume chamber and said second volume chamber are partitioned by a baffle plate, said second passage is formed by an opening formed in said baffle plate, and said valve comprises a valve seat provided in said opening in said baffle plate, a valve body which can seat in said valve seat for closing said opening in said baffle plate, and a spring for pushing said valve body towards a seated position.

12. An exhaust noise suppressor as defined in claim 1, wherein said first passage comprises a downstream part of said inlet tube.

13. An exhaust noise suppressor as defined in claim 12, wherein said valve is provided in said opening of said first passage.

14. An exhaust noise suppressor as defined in claim 1, wherein said first passage comprises a branch which branches off said inlet tube, said branch pipe having an opening into said first volume chamber.

15. An exhaust noise suppressor as defined in claim 14, wherein said valve is provided in said opening of said first passage.

16. An exhaust noise suppressor as defined in claim 1, wherein said orifice of said inlet tube comprises a first group of small holes formed in said inlet tube in said expansion chamber, said opening of said first passage comprises a second group of small holes formed in said inlet tube in said first volume chamber, and said first passage comprises a portion of said inlet tube from said first group of small holes to said second group of small holes.

17. An exhaust noise suppressor as defined in claim 1, wherein said third passage comprises a pipe, and said valve comprises a valve seat provided in an opening of said pipe, a valve body which can seat in said valve seat for closing said opening of said pipe, and a spring for pushing said valve body towards a seated position.

18. An exhaust noise suppressor as defined in claim 1, wherein said second passage and said third passage comprise two pipes arranged coaxially with said tail tube.

19. An exhaust noise suppressor as defined in claim 1, wherein said second volume chamber and said expansion chamber are partitioned by a baffle plate, said third passage comprises a pipe passing through said baffle plate, and said valve comprises a valve seat provided in an opening of said pipe which extends from said baffle plate, a valve body which can seat in said valve seat for closing said opening of said pipe, and a spring for pushing said valve body towards a seated position.

20. An exhaust noise suppressor as defined in claim 1, wherein said first volume chamber and said expansion chamber are partitioned by a baffle plate, said third passage comprises a pipe passing through said first volume chamber, and said valve comprises a valve seat provided in an opening of said pipe which is formed in said baffle plate, a valve body which can seat in said valve seat for closing said opening of said pipe, and a spring for pushing said valve body towards a seated position.

* * * * *